US007910280B2

(12) United States Patent
Oyama

(10) Patent No.: US 7,910,280 B2
(45) Date of Patent: Mar. 22, 2011

(54) METHOD FOR PRODUCING POLYMERIZED TONER

(75) Inventor: Fuminari Oyama, Tokyo (JP)

(73) Assignee: Zeon Corporation, Tokyo (JP)

( * ) Notice: Subject to any disclaimer, the term of this patent is extended or adjusted under 35 U.S.C. 154(b) by 358 days.

(21) Appl. No.: 12/260,767

(22) Filed: Oct. 29, 2008

(65) Prior Publication Data

US 2009/0111045 A1 Apr. 30, 2009

(30) Foreign Application Priority Data

Oct. 31, 2007 (JP) ..... 2007-284325

(51) Int. Cl.
*G03G 5/00* (2006.01)

(52) U.S. Cl. ..... 430/137.15; 430/137.16

(58) Field of Classification Search ..... 430/137.15, 430/137.16

See application file for complete search history.

(56) References Cited

U.S. PATENT DOCUMENTS

2006/0269866 A1* 11/2006 Hagino ..... 430/137.15

FOREIGN PATENT DOCUMENTS

| | | | |
|---|---|---|---|
| JP | 08-160661 | A | 6/1996 |
| JP | 2003-275514 | A | 9/2003 |
| JP | 2004-302098 | A | 10/2004 |
| JP | 2004-302099 | A | 10/2004 |

* cited by examiner

*Primary Examiner* — Hoa V Le

(74) *Attorney, Agent, or Firm* — Westerman, Hattori, Daniels & Adrian, LLP

(57) ABSTRACT

The present invention provides a method of producing a polymerized toner which removes a by-product microparticle generated as a by-product upon polymerization in a by-product microparticle removing step, efficiently obtains a wet colored resin particle which has low moisture content (wet cake) by decreasing clogs caused at filter element in a dewatering step, enhances a drying efficiency (shorten the drying time) in a drying step, has an excellent productivity and a printing ability.

12 Claims, No Drawings

METHOD FOR PRODUCING POLYMERIZED TONER

BACKGROUND OF THE INVENTION

1. Field of the Invention

The present invention relates to a method of producing a polymerized toner (hereinafter, it may be simply referred as "a toner") used for development of a latent image of electrostatics in an electrophotography, an electrostatic recording method and an electrostatic printing process or the like. Particularly, the present invention relates to a method of producing a polymerized toner which is high dewatering efficiency and drying efficiency and is excellent in productivity.

2. Description of the Related Art

A method of producing a colored resin particle which is a main component of the toner is classified into a dry method and a wet method. As the dry method, there may be a pulverization method or the like, which is a method of producing the colored resin particle by melting and kneading a binder resin with a colorant and other additives or the like, and then pulverizing and classifying it. In contrast, as the wet method, there may be a polymerization method, a solution suspension method or the like, which is a method of producing the colored resin particle in an aqueous dispersion medium.

A form of the colored resin particle obtained by the pulverization method is an indeterminate, whereas a form of the colored resin particle obtained by the wet method such as the polymerization method and the solution suspension method is close to spherical form and has a small particle diameter and narrow particle size distribution.

Among the wet methods, by the polymerization method, a polymerized toner having easily-controlled particle diameter, spherical form with a small particle diameter and narrow particle diameter distribution can be produced.

Recently, an attempt to further minimize the particle size of the toner is made with the further rise in the demand level to an image printing having high resolution and high quality. Even the polymerized toner, new problems have been pointed out.

As the above-mentioned problems, in the polymerization step of producing the polymerized toner, it is pointed out to have an adverse affect on the productivity of the toner and a printing ability by producing a particle having unnecessary microparticle diameter as a by-product other than desired colored resin particle.

A minute by-product particle of the majority is a microparticle having less than 0.6 μm of particle diameter, so called, submicron order and not containing the colorant (hereinafter, it may be referred as "a by-product microparticle").

If such the by-product microparticle is produced as a by-product, a part of released by-product microparticle clogs the filter upon filtration of the obtained colored resin particle from the aqueous dispersion medium and a filtration rate decreases, thereby causing a decrease in a production efficiency of the toner. Also, if the polymerized toner containing a lot of by-product microparticles is used for image-forming, the by-product microparticle is likely adhere to members in a developer upon printing. When plural prints are printed, the attached by-product microparticle is gradually accumulated so as to cause adherence to the member, thus it is known to have an adverse affect on the printing ability of the toner.

To obtain the polymerized toner, in addition to need to remove the by-product microparticle which is produced as a by-product upon polymerization, it is also necessary to dry the wet colored resin particle (wet cake) which is obtained by carrying out solid-liquid separation of the colored resin particle from the aqueous dispersion of the colored resin particle and the washing and dewatering process. When the wet cake after the washing and dewatering process is dried, if water is not sufficiently-removed and dried, it takes much time to dry thereof, thus drying efficiency is decreased and a problem to be declined a productivity of the toner is occurred.

The applicant have been continued to make an attempt to improve efficiency of the steps such as the solid-liquid separation (filtration), washing and dewatering in order to efficiently obtain desired colored resin particle without deteriorating a quality of the colored resin particle.

JP Patent Application Laid-open (JP-A) No. H8-160661 discloses the method of producing the polymerized toner by carrying out the solid-liquid separation, washing and dewatering by the use of continuous belt filter, Siphon Peeler Centrifuge, or both of them as a washing dehydrator.

JP Patent Application Laid-open (JP-A) No. 2004-302099 discloses the method of producing the polymerized toner by efficiently carrying out a vacuum deliquoring of a cake by giving an oscillation or an impact to a cake layer formed on a filter fabric at a part of the vacuum deliquoring zone of the vacuum belt filter in the step of filtering and washing by the use of the vacuum belt filter.

Further, JP Patent Application Laid-open (JP-A) No. 2004-302098 discloses the method of producing the polymerized toner in the step of filtering and washing by the use of a vacuum belt filter by bringing a filtrate in a gravity-settling zone and a filtrate in a cake forming zone back on a cake of a vacuum filtrating zone, peeling the cake and using a washing drainage which washes the filter fabric as a wash solution.

Further, JP Patent Application Laid-open (JP-A) No. 2003-275514 discloses the method of producing the polymerized toner by using a horizontal belt vacuum filtration apparatus provided with a filter element whose lengthwise tension strength is 200 kgf/30 mm or more, a ventilation volume is preferably 150 cc/min/cm$^2$ or less upon separation of the colored resin particle from the dispersion of the colored resin particle.

However, a method of producing the toner whose process is provided with a step of removing the by-product microparticle generated as a by-product upon polymerization from the colored resin particle, which controls the state of the dispersion of the colored resin particle in the solid-liquid separation (filtration) and the washing and dewatering of the process of producing the toner, and which has an excellent productivity and printing ability has not been attained.

SUMMARY OF THE INVENTION

An object of the present invention is to provide a method of producing a polymerized toner which removes a microparticle generated as a by-product upon polymerization in a by-product microparticle removing step, efficiently obtains a wet colored resin particle which has low moisture content (wet cake) by decreasing clogs caused at filter element in a dewatering step, enhances a drying efficiency (shorten the drying time) in a drying step, has an excellent productivity and a printing ability As the result of diligent researches made to attain the above object, the inventor of the present invention found out that a process is carried out by: washing to enhance a degree of washing of the colored resin particle till an electric conductivity of the filtrate obtained by filtering the redispersion of the colored resin particle is lowered to the specific amount or less in the separation and washing step; subsequently adjusting pH of the redispersion of the colored resin particle which has the high degree of washing to specific alkalinity and then removing the by-product microparticle from the pH adjusted redispersion of the colored resin particle, in the by-product microparticle removing step; subsequently adding specific flocculant to the redispersion of the colored resin particle from which the by-product microparticle is removed to aggregating the colored resin particle, and then dewatering in the dewatering step, whereby the wet colored resin particle having low moisture content (wet cake) can be efficiently obtained without causing clogs at the filter element in the dewatering step, and the drying efficiency is enhanced (shorten of drying time) in the drying step, and the toner which has an excellent productivity and printing ability can be obtained, thus the present invention has been completed based on the above knowledge.

That is, a method of producing a polymerized toner of the present invention comprises; a step obtaining an aqueous dispersion of a colored resin particle by forming the colored resin particle by polymerization method; a separation and washing step obtaining a redispersion of the colored resin particle by separation and washing of the colored resin particle in the aqueous dispersion of the colored resin particle, followed by redispersing the colored resin particle into an ion-exchange water; a by-product microparticle removing step removing a by-product microparticle from the redispersion of the colored resin particle; a dewatering step obtaining a wet colored resin particle by dewatering the redispersion of the colored resin particle; and a drying step drying the wet colored resin particle, wherein, in the above-mentioned separation and washing step, a belt filter is used as a device conducting separation and washing, and the separation and washing is carried out to enhance a degree of washing of the colored resin particle until an electric conductivity of filtrate becomes 500 μS/cm or less provided that the electric conductivity is determined with respect to the filtrate obtained by such manner that the colored resin particle obtained by separation and washing with the use of the belt filter is redispersed into the ion-exchange water to prepare the redispersion of the colored resin particle with 20 weight % of solid content concentration and filtrate it and then the colored resin particle is redispersed again into the ion-exchange water to obtain the redispersion of the colored resin particle with the predetermined solid content concentration;

wherein, in the by-product microparticle removing step, pH of the redispersion of the colored resin particle with the predetermined solid content concentration is adjusted to 9-12, the by-product microparticle is removed from the redispersion of the pH adjusted colored resin particle, followed by redispersing the colored resin particle into the ion-exchange water to obtain the redispersion of the colored resin particle with the predetermined solid content concentration;

wherein, in the dewatering step, an acid and/or a cationic polymer flocculent as a flocculant is added into the redispersion of the colored resin particle with the predetermined solid content concentration to aggregate the colored resin particle, followed by dewatering to obtain the wet colored resin particle.

According to the above-mentioned method of producing a polymerized toner in the present invention, a by-product microparticle generated upon polymerization is removed in a by-product microparticle removing step, whereby clogs caused at filter element can be decreased and a wet colored resin particle which has low moisture content (wet cake) can be efficiently obtained in a dewatering step, and a drying efficiency (shorten the drying time) can also be enhanced in a drying step, thus a method of producing a polymerized toner excellent in a productivity and a printing ability is provided.

DETAILED DESCRIPTION OF THE INVENTION

The method of producing a polymerized toner of the present invention comprises; a step obtaining an aqueous dispersion of a colored resin particle by forming the colored resin particle by polymerization method; a separation and washing step obtaining a redispersion of the colored resin particle by separation and washing of the colored resin particle in the aqueous dispersion of the colored resin particle, followed by redispersing the colored resin particle into an ion-exchange water; a by-product microparticle removing step removing a by-product microparticle from the redispersion of the colored resin particle; a dewatering step obtaining a wet colored resin particle by dewatering the redispersion of the colored resin particle; and a drying step drying the wet colored resin particle, wherein, in the above-mentioned separation and washing step, a belt filter is used as a device conducting separation and washing, and the separation and washing is carried out to increase a degree of washing of the colored resin particle until an electric conductivity of filtrate becomes 500 μS/cm or less provided that the electric conductivity is determined with respect to the filtrate obtained by such manner that the colored resin particle obtained by separation and washing with the use of the belt filter is redispersed into the ion-exchange water to prepare the redispersion of the colored resin particle with 20 weight % of solid content concentration and filtrate it and then the colored resin particle is redispersed again into the ion-exchange water to obtain the redispersion of the colored resin particle with the predetermined solid content concentration;

wherein, in the by-product microparticle removing step, pH of the redispersion of the colored resin particle with the predetermined solid content concentration is adjusted to 9-12, the by-product microparticle is removed from the redispersion of the pH adjusted colored resin particle, followed by redispersing the colored resin particle into the ion-exchange water to obtain the redispersion of the colored resin particle with the predetermined solid content concentration;

wherein, in the dewatering step, an acid and/or a cationic polymer flocculant as a flocculent is added into the redispersion of the colored resin particle with the predetermined solid content concentration to aggregate the colored resin particle, followed by dewatering to obtain the wet colored resin particle.

As the polymerization method, there may be a suspension polymerization method, an emulsion aggregation polymerization method and a dispersion polymerization method or the like. In the method of producing the polymerized toner provided by the present invention, it is preferable to employ the suspension polymerization method.

Hereinafter, the method of producing the polymerized toner by means of the suspension polymerization method will be described using as a representative example.

(1) Process of Obtaining an Aqueous Dispersion of a Colored Resin Particle

The present process includes (1-1) Process of preparing a polymerizable monomer composition, (1-2) Process of forming a droplet and (1-3) Polymerization process, and desired aqueous dispersion of the colored resin particle can be obtained by the above-mentioned each process.

(1-1) Process of Preparing a Polymerizable Monomer Composition

Firstly, a polymerizable monomer, a colorant and other additives such as a charge control agent, if required, are mixed and dissolved to prepare a polymerizable monomer composition. For example, a media disperser is use for mixing when the polymerizable monomer composition is prepared.

The polymerizable monomer in the present invention means a monomer having a polymerizable functional group. As a main component of the polymerizable monomer, a monovinyl monomer is preferably used. As the monovinyl monomer, for example, there may be, styrene; a styrene derivative such as vinyl toluene, α-methyl styrene or the like; acrylic acid and methacrylic acid; acrylic acid ester such as methyl acrylate, ethyl acrylate, propyl acrylate, butyl acrylate, 2-ethylhexyl acrylate and dimethylaminoethyl acrylate or the like; methacrylic acid ester such as methyl methacrylate, ethyl methacrylate, propyl methacrylate, butyl methacrylate, 2-ethylhexyl methacrylate, dimethylaminoethyl methacrylate or the like; an amide compound such as acrylamide, methacrylamide or the like; olefin such as ethylene, propylene, butylene or the like. The above monovinyl monomers may be used alone or in combination of two or more kinds.

Among them, the styrene, the styrene derivative, acrylic acid ester and methacrylic acid ester may be suitably used as the monovinyl monomer.

As a part of the polymerizable monomer, in order to improve shelf stability of the toner (blocking resistance), any crosslinkable polymerizable monomer may be preferably used together with the above-mentioned monovinyl monomer. The crosslinkable polymerizable monomer means a monomer having two or more polymerizable functional groups. As the crosslinkable polymerizable monomer, for example, there may be, an aromatic divinyl compound such as divinyl benzene, divinyl naphthalene, a derivative thereof or the like; ethylenic unsaturated carboxylic ester such as ethylene glycol dimethacrylate, diethylene glycol dimethacrylate or the like; divinyl compound such as N,N-divinylaniline, divinyl ether or the like; a compound containing three or more vinyl groups such as trimethylolpropane trimethacrylate, dimethylolpropane tetracrylate or the like. The crosslinkable polymerizable monomers may be used alone or in combination of two or more kinds.

In the present invention, it is desirable that the ratio of the crosslinkable polymerizable monomer is generally from 0.1 to 5 parts by weight, preferably from 0.3 to 2 parts by weight, with respect to the monovinyl monomer of 100 parts by weight.

Also, as a part of the polymerizable monomer, in order to improve a balance between the shelf stability of the toner and low-temperature fixing ability, any macromonomer may be preferably used together with the above-mentioned monovinyl monomer. The macromonomer means a reactive oligomer or polymer having a polymerizable carbon-carbon unsaturated bond at the end of molecular chain and generally having a number average molecular weight (Mn) from 1,000 to 30,000. As the macromonomer, an oligomer or a polymer having a glass transition temperature (Tg) which is higher than that of a polymer (binder resin) obtained by polymerization of the polymerizable monomer is preferably used.

In the present invention, it is desirable that the ratio of the macromonomer is generally from 0.01 to 10 parts by weight, preferably 0.03 to 5 parts by weight, more preferably 0.1 to 2 parts by weight, with respect to the monovinyl monomer of 100 parts by weight.

In the present invention, a colorant may be used. In the case of producing a colored toner, wherein there may be generally a black toner, a cyan toner, a yellow toner and a magenta toner, a black, cyan, yellow or magenta colorant may be respectively used.

In the present invention, as a black colorant, there may be used a colorant such as carbon black, titanium black, a magnetic particle including zinc-ferric oxide, nickel-ferric oxide or the like.

As the cyan colorant, for example, a compound such as a copper phthalocyanine pigment, a derivative thereof, an anthraquinone pigment or the like may be used. Specifically, there may be a C. I. Pigment Blue 2, 3, 6, 15, 15:1, 15:2, 15:3, 15:4, 16, 17:1, and 60 or the like.

As the yellow colorant, for example, a compound such as an azo pigment including a monoazo pigment, a disazo pigment or the like, a condensation polycyclic pigment or the like may be used. Specifically, there may be C. I. Pigment yellow 3, 12, 13, 14, 15, 17, 62, 65, 73, 74, 83, 93, 97, 120, 138, 155, 180, 181, 185 and 186 or the like.

As the magenta colorant, for example, a compound such as an azo pigment including a monoazo pigment, a disazo pigment or the like, a condensation polycyclic pigment or the like may be used. Specifically, there may be C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 251, and C. I. Pigment Violet 19 or the like.

In the present invention, each colorant may be used alone or in combination of two or more kinds. It is desirable that the ratio of the colorant is preferably from 1 to 10 parts by weight, with respect to 100 parts by weight of the monovinyl monomer.

As other additives, in order to improve a peeling ability from a fixing roller for the toner, a parting agent is preferably used.

As the parting agent, a generally used parting agent for a toner may not be particularly limited. For example, there may be a polyolefin wax such as low-molecular-weight polyethylene, low-molecular-weight polypropylene, low-molecular-weight polybutylene or the like; a natural wax such as candelilla, a carnauba wax, a rice wax, a haze wax, jojoba or the like; a petroleum wax such as paraffin, microcrystalline, petrolatum or the like; a mineral wax such as montan, ceresin, ozokerite or the like; a synthesized wax such as a Fischer-Tropsch wax or the like; an esterified compound of polyalcohol such as pentaerythritol ester including pentaerythritol tetramyristate, pentaerythritol tetrapalmitate, pentaerythritol tetrastearate, pentaerythritol tetralaurate or the like, dipentaerythritol ester including dipentaerythritol hexamyristate, dipentaerythritol hexapalmitate, dipentaerythritol hexylaurate or the like, which may be used alone or in combination of two or more kinds.

In the present invention, it is desirable that the ratio of the parting agent is generally from 0.1 to 30 parts by weight, preferably from 1 to 20 parts by weight, with respect to the monovinyl monomer of 100 parts by weight.

As other additives, in order to improve charge property of a toner, various kinds of charge control agents having positive or negative charge property can be used.

As the charge control agent, a generally used charge control agent for a toner may not be particularly limited. In the present invention, the positive charge control agent is preferably used from the viewpoint of obtaining a toner having positive charge property. Further, a positive charge control resin is preferably used since the positive charge control resin has high compatibility with the polymerizable monomer and can impart a stable charging property (charge stability) to a toner particle.

As the positive charge control resin, for example, several kinds of commercial products can be used. As a product from Fujikurakasei Co., Ltd., there may be a FCA-161P (product name, styrene/acrylic resin), FCA-207P (product name, styrene/acrylic resin), FCA-201-PS (product name, styrene/acrylic resin) or the like.

In the present invention, it is desirable that the ratio of the charge control agent is generally from 0.01 to 10 parts by weight, preferably from 0.03 to 8 parts by weight, with respect to the monovinyl monomer of 100 parts by weight.

As other additives, a molecular weight modifier may be preferably used.

As the molecular weight modifier, a generally used molecular weight modifier for a toner may not be particularly limited, for example, there may be mercaptans such as t-dodecyl mercaptan, n-dodecyl mercaptan, n-octyl mercaptan, 2,2,4,6,6-pentamethylheptane-4-thiol or the like; thiuram disulfides such as tetramethylthiuram disulfide, tetraethylthiuram disulfide, tetrabutylthiuram disulfide, N,N'-dimethyl-N,N'-diphenylthiuram disulfide, N,N'-dioctadecyl-N,N'-diisopropylthiuram disulfide or the like. The molecular weight modifiers may be used alone or in combination of two or more kinds.

In the present invention, it is desirable that the ratio of the molecular weight modifier is generally from 0.01 to 10 parts by weight, preferably from 0.1 to 5 parts by weight, with respect to the monovinyl monomer of 100 parts by weight.

(1-2) Process of Forming a Droplet

After a polymerizable monomer composition obtained by the above (1-1) Process of preparing a polymerizable monomer composition is dispersed in an aqueous medium containing a dispersion stabilizer and a polymerization initiator is added, a forming the droplet of the polymerizable monomer composition is carried out. A method of forming the droplet may not be particularly limited. For example, a device that enables strong agitation such as an in-line type emulsifying and dispersing machine (product name: MILDER; manufactured by Pacific Machinery & Engineering Co., Ltd.), a high-speed emulsifying and dispersing machine (product name: T. K. Homomixer MARK II; manufactured by PRIMIX Corporation) or the like can be used.

In the forming droplets, in order to improve a particle diameter control of the colored resin particle and a degree of circularity, a dispersion stabilizer which is contained in an aqueous dispersion medium is used.

The aqueous dispersion medium may be solely water, but may be used water-soluble solvent such as lower alcohol and lower ketone or the like in combination with water.

As the dispersion stabilizer, for example, there may be sulfate such as barium sulfate, calcium sulfate or the like, carbonate such as barium carbonate, calcium carbonate, magnesium carbonate or the like, phosphate such as calcium phosphate or the like, metal compound such as metal oxide including aluminum oxide, titanium oxide or the like and metal hydroxide including aluminum hydroxide, magnesium hydroxide, ferric hydroxide or the like; a water-soluble polymer compound such as polyvinyl alcohol, methyl cellulose and gelatin or the like; an organic polymer compound such as an anionic surfactant, a nonionic surfactant and an ampholytic surfactant or the like. Among them, the metal hydroxide is preferable. Particularly, the magnesium hydroxide whose pH range is generally used from pH 7.5 to 11 is preferable.

Among the above-mentioned dispersion stabilizers, a dispersion stabilizer containing a colloid of a hardly water-soluble metal hydroxide (poor water solubility inorganic compound) which can dissolve in an acid solution is preferably used. The dispersion stabilizer may be used alone or in combination of two or more kinds.

An added amount of the dispersion stabilizer may be preferably from 0.1 to 20 parts by weight, more preferably from 0.2 to 10 parts by weight, with respect to the polymerizable monomer of 100 parts by weight.

As the polymerization initiator, for example, there may be inorganic persulfate such as potassium persulfate and ammonium persulfate or the like; an azo compound such as 4,4'-azobis(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile), 2,2'-azobisisobutyronitrile or the like; organic peroxide such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate, t-butylperoxyisobutyrate or the like. Among the above, the organic peroxide is preferably used.

The polymerization initiator may be added to the polymerizable monomer composition at a stage after dispersing the polymerizable monomer composition in the aqueous dispersion medium containing the dispersion stabilizer and before forming droplets as mentioned above, but also the polymerization initiator may be directly added to the polymerizable monomer composition.

An added amount of the polymerization initiator may be preferably from 0.1 to 20 parts by weight, more preferably from 0.3 to 15 parts by weight, further more preferably 1.0 to 10 parts by weight, with respect to the monovinyl monomer of 100 parts by weight.

(1-3) Polymerization Process

An aqueous dispersion of a colored resin particle can be obtained by carrying out a suspension polymerization of suspending solution (aqueous dispersion containing droplets of the polymerizable monomer composition) obtained by the above (1-2) Process of Forming Droplets in the Presence of the Polymerization Initiator.

In the polymerization process, in order to polymerize the droplets of the polymerizable monomer composition under stable dispersion state, it is preferable to proceed the polymerization reaction while carrying out the dispersion treatment by successively agitating from the above (1-2) Process of forming droplets.

In the polymerization process, a polymerization temperature may be preferably 50° C. or more, more preferably from 60 to 98° C. Also, a polymerization time may be preferably for 1 to 20 hours, more preferably for 2 to 15 hours.

In the present invention, it is preferable to form a so-called core-shell type (or "capsule type") colored resin particle, which can be obtained in such manner that a colored resin particle obtained by the polymerization process is used as a core layer and a shell layer, a material of which is different from that of the core layer is made around the core layer.

The core-shell type colored resin particle can take a balance of lowering of fixing temperature of a toner and prevention of aggregation at storage by covering the core layer comprising a substance having a low-softening point with a substance having a softening point higher than that of the core layer.

A method for producing the core-shell type colored resin particle mentioned above may not be particularly limited, and may be produced by a conventional method. An in situ polymerization method and a phase separation method are preferable from the viewpoint of manufacturing efficiency.

The method of producing the core-shell type colored resin particle according to the in situ polymerization method will be hereinafter described.

A polymerization monomer (a polymerizable monomer for shell) for forming a shell layer and a polymerization initiator for shell are added to an aqueous dispersion medium to which a colored resin particle is dispersed followed by polymerization, thus the core-shell type colored resin particle can be obtained.

As the polymerizable monomer for shell, the same polymerizable monomer as aforementioned can be used. Among them, it is preferable to use the monomer which can provide a polymer having Tg of more than 80° C. such as styrene and methyl methacrylate or the like alone or in combination of two or more kinds.

As the polymerization initiator for shell used for polymerization of the polymerizable monomer for shell, there may be a polymerization initiator such as a metal persulfate including potassium persulfate, ammonium persulfate or the like; a water-soluble azo compound including 2,2'-azobis(2-methyl-N-(2-hydroxyethyl)propionamide), 2,2'-azobis-(2-methyl-N-(1,1-bis(hydroxymethyl)-2-hydroxyethyl)propionamide) or the like. An added amount of the polymerization initiator for shell may be preferably from 0.1 to 30 parts by weight, more preferably from 1 to 20 parts by weight, with respect to the polymerizable monomer for shell of 100 parts by weight.

A polymerization temperature of the shell layer may be preferably 50° C. or more, more preferably from 60 to 95° C. Also, a polymerization time of the shell layer may be preferably for 1 to 20 hours, more preferably for 2 to 15 hours.

A volume average particle diameter ($Dv_1$) of the colored resin particle obtained by the above (1) Process of obtaining an aqueous dispersion of a colored resin particle may be preferably from 4 to 10 μm, more preferably from 5 to 9 μm from the viewpoint of image reproducibility.

If the volume average particle diameter ($Dv_1$) of the colored resin particle is less than the above range, a flowability of the toner to be obtained lowers, deterioration of an image quality by fog or the like is likely to occur or printing ability may have an adverse affect. On the other hand, if the volume average particle diameter ($Dv_1$) of the colored resin particle exceeds the above range, resolution of an image to be obtained is likely to decline and may have the adverse affect on the printing ability.

Also, an average degree of circularity of the colored resin particle is preferably from 0.95 to 0.995, more preferably from 0.97 to 0.985 from the viewpoint of image reproducibility.

If the average degree of circularity of the colored resin particle is less than the above range, thin line reproducibility of a toner printing to be obtained is likely to decline and the printing ability may have an adverse affect.

In the present invention, "degree of circularity" is defined as a value that boundary length of a circle having the same projected area as a particle image divided by a boundary length of a projection image of the particle. Also, the average degree of circularity in the present invention is used as a concise method which quantitatively represents a shape of a particle and is an indicator which represents a degree of concavity and convexity of the colored resin particle. In the case that the colored resin particle is a perfect spherical form, the average degree of circularity represents "1", and as a surface shape of the colored resin particle becomes more complex, the value becomes smaller. Particles having a diameter which is equivalent to a circle diameter with 0.4 μm or more is measured, and then the degree of circularity (Ci) of n pieces of each particle is calculated by the following Formula 1 to obtain each n-particle, after that the average degree of circularity (Ca) is calculated by the following Formula 2.

Degree of circularity (Ci)=Boundary length of a circle which is equivalent to the projected area of a particle/Boundary length of particle projected image — Formula 1

Calculating formula 2

$$Ca = \frac{\sum_{i=1}^{n} (Ci \times fi)}{\sum_{i=1}^{n} (fi)}$$

In the Formula 2, "fi" is frequency of a particle having the degree of circularity (Ci).

The degree of circularity can be measured by means of Particle Size and Shape Imaging System manufactured by SYSMEX CORPORATION such as "FPIA-2000", "FPIA-2100" and "FPIA-3000" or the like.

(2) Separation and Washing Process

The present process comprises (2-2) Separation and Washing process by belt filter and (2-3) Process of obtaining redispersion of the colored resin particle, preferably comprises (2-1) Process of removing a dispersion stabilizer by acid. Desired washing can be carried out by each process.

In addition, the series of the above-mentioned process (2-2) to (2-3) can be carried out for several times, if required.

(2-1) Process of Removing a Dispersion Stabilizer by Acid

In order to remove unnecessary dispersion stabilizer which remains in the aqueous dispersion of the colored resin particle obtained by the (1) Process of obtaining an aqueous dispersion of a colored resin particle, it is preferable to carry out a removing and washing of the dispersion stabilizer by adding acid.

If a dispersion stabilizer soluble in acid is used, pH adjustment is carried out by adding acid in the aqueous dispersion of the colored resin particle, and unnecessary dispersion stabilizer which remains in the aqueous dispersion of the colored resin particle is dissolved in water and can be removed.

As acid to be added if the dispersion stabilizer soluble in acid is used, it may not be particularly limited. For example, there may be inorganic acid such as sulfuric acid, hydrochloric acid, nitric acid or the like, and organic acid such as formic acid, acetic acid or the like. Among them, sulfuric acid is particularly preferably used as removing efficiency of the dispersion stabilizer is high and adverse affect on production facilities is small.

pH of the aqueous dispersion of the colored resin particle to be adjusted by adding acid, that is, pH of the aqueous dispersion of the colored resin particle before separation and washing by means of the belt filter is preferably from 5 to 7, more preferably from 5.5 to 6.5.

If pH of the aqueous dispersion of the colored resin particle is less than the above range, large amount of washing water may be required for washing because of increase in a degree of acidity of the aqueous dispersion of the colored resin particle. On the other hand, if pH of the aqueous dispersion of the colored resin particle exceeds the above range, removal of the dispersion stabilizer may become difficult.

(2-2) Separation and Washing Process by Belt Filter

It is preferable that the colored resin particle obtained by the above (2-1) Process of removing a dispersion stabilizer by acid is subjected to a solid-liquid separation by means of the belt filter as a device for carrying out separation and washing, and washing by means of washing water such as ion-exchange water to form a wet colored resin particle (wet cake).

In the present process, the belt filter is used as a device for carrying out separation and washing. The colored resin particle obtained by the above Process (2-1) is supplied on the belt filter and subjected to separation and washing to form the wet colored resin particle (wet cake). Thereafter, washing water such as ion-exchange water is uniformly sprinkled on the wet cake and a uniform washing is carried out, thus a desired wet colored resin particle (wet cake) can be formed.

In the present process, as the belt filter to be used as a device for carrying out separation and washing, there may not be particular limited if a belt filter can obtain desired wet colored resin particle (wet cake). Various sorts of commercial belt filters can be used, for example, continuous belt filter manufactured by Sumitomo Heavy Industries, Ltd. (product name: Eagle filter), vacuum horizontal belt filter manufactured by Daiki Ataka Engineering Co., Ltd. (product name: Daiki ADPEC filter) and horizontal belt filter manufactured by TSUKISHIMA KIKAI Co., Ltd. (product name: TSUKISHIMA—Horizontal Belt Filter) or the like are typically exemplified.

The amount of washing water such as ion-exchange water used in washing is preferably in 2 to 20 times as amount as a solid content in the aqueous dispersion of the colored resin particle, more preferably in 3 to 10 times, further more preferably in 3 to 6 times.

If the amount of the washing water is less than the above range, removal of impurity contained in the wet cake is not sufficiently carried out by washing and may have an adverse affect on the printing ability of a toner. On the other hand, if the amount of the washing water exceeds the above range, excessive washing is carried out, therefore a productivity of a toner may be declined.

(2-3) Process of Obtaining a Dispersion of a Colored Resin Particle

A degree of washing of the colored resin particle is enhanced until an electric conductivity of a filtrate becomes 500 μS/cm or less, provided that the wet colored resin particle (wet cake) obtained by the (2-2) Process of separation and washing by belt filter is redispersed into the ion-exchange water to prepare the redispersion of the colored resin particle with 20 weight % of solid content concentration and the filtrate is obtained by filtrating the redispersion of the colored resin particle. Thereafter, the colored resin particle is again redispersed into the ion-exchange water, thus obtaining the redispersion of the colored resin particle with the predetermined solid content concentration.

In the present invention, the electric conductivity of filtrate is used for an indicator to evaluate the degree of washing of the colored resin particle.

The electric conductivity of filtrate obtained by filtrating the redispersion of the colored resin particle is 500 μS/cm or less, preferably 100 μS/cm or less, more preferably 50 μS/cm or less.

If the electric conductivity of filtrate exceeds the above range, it is judged that the degree of washing of the colored resin particle is low and the washing of the colored resin particle is insufficient and it is necessary to enhance the degree of washing of the colored resin particle by repeatedly carrying out the series of process in (2-2) to (2-3).

In addition, the electric conductivity is a value which is measured by means of a conductance meter, for example, a conductance meter manufactured by HORIBA, Ltd. (product name: ES-12) can be used.

In the present process, adjusting the solid content concentration of a redispersion of the colored resin particle to 20 parts by weight is a specified condition to measure the electric conductivity which is an indicator of the degree of washing of the colored resin particle, it dose not mean that the redispersion of the colored resin particle with 20 parts by weight of solid content concentration is used for next process (3) Process of removing a by-product microparticle.

In the present process, a colored resin particle which is approved that the degree of washing of the colored resin particle is enhanced to desired level is obtained in the final step of the separation and washing process from the result of measurement test of the electric conductivity. Then, the redispersion of the colored resin particle may be obtained by redispersing at an appropriate solid content concentration using the ion-exchange water.

In addition, the above-mentioned appropriate solid content concentration is generally 15 to 35% by weight, preferably 20 to 25% by weight, thus it can be used for next (3) Process of Removing a By-Product Microparticle.

As an example, in the (2-2) process, a part of the wet colored resin particle (wet cake) formed on the belt filter is taken and dispersed again in the ion-exchange water to prepare a redispersion of the colored resin particle with 20 parts by weight of solid content concentration. If the electric conductivity of filtrate obtained by filtration of the redispersion is 500 μS/cm or less, it can be judged that remaining wet colored resin particle (wet cake) formed on the belt filter is a colored resin particle enhanced to desired degree of washing.

(3) Process of Removing a By-Product Microparticle

The present process comprises (3-1) pH adjustment process of redispersion of a colored resin particle, (3-2) Removing process of a by-product microparticle and (3-3) Process of obtaining a redispersion of a colored resin particle, and enables desired removal of a by-product microparticle.

(3-1) pH Adjustment Process of Redispersion of a Colored Resin Particle

A redispersion of the colored resin particle with predetermined solid content concentration obtained by the (2) Process of separation and washing is pH adjusted to specific alkalinity and dispersed. Then, a by-product microparticle which adheres to a surface of the colored resin particle can be released from the colored resin particle.

pH of the redispersion of the colored resin particle with predetermined solid content concentration is 9 to 12, preferably 9.5 to 11.5.

If pH of the redispersion of the colored resin particle is less than the above range, the by-product microparticle which adheres to the surface of the colored resin particle can not be sufficiently released from the colored resin particle, therefore, it causes a clog on a filter element, may decrease a dewatering efficiency and have an adverse affect on a printing ability in the following (4) dewatering process. On the other hand, if pH of the redispersion of the colored resin particle exceeds the above range, the by-product microparticle which adheres to the surface of the colored resin particle can be released from the colored resin particle. However, it may decrease the dewatering efficiency since a lot of flocculant is necessary to aggregate the colored resin particle in the following (4) Dewatering process.

Alkali used in pH adjustment may not be particularly limited if alkali can adjust the redispersion of the colored resin particle with predetermined solid content concentration to pH 9 to 12. Preferably, pH is adjusted with the use of a solution of alkali metal hydroxide.

As the aqueous solution of alkali metal hydroxide, for example, there may be aqueous solution of sodium hydroxide, aqueous solution of potassium hydroxide and aqueous solution of lithium hydroxide or the like. Among them, aqueous solution of sodium hydroxide is preferably used.

Alkali used in pH adjustment is preferably used after controlling a concentration to low concentration. It is preferable to use alkali which is controlled to solutions containing alkali whose concentration is preferably 0.01 to 1.0% by weight, more preferably 0.05 to 0.5% by weight, further more preferably 0.07 to 0.3% by weight.

In addition, the added amount of alkali used in pH adjustment depends on the alkali concentration, however, if pH of the redispersion of the colored resin particle after adding alkali is adjusted to 9 to 12, the added amount may not be particularly limited.

If the alkali concentration used in the pH adjustment is less than the above range, large amount of alkali is required to release the by-product microparticle which adheres to the surface of the colored resin particle from the colored resin particle, the solid content concentration of the redispersion of the colored resin particle may be declined and the removing efficiency of the by-product microparticle may be decreased as increasing an amount of liquid. On the other hand, if the alkali concentration used in the pH adjustment exceeds the above range, pH adjustment to specific alkalinity becomes difficult and the removing efficiency of the by-product microparticle may be decreased.

(3-2) Removing Process of a By-Product Microparticle

The desired wet colored resin particle (wet cake) can be obtained by removing the by-product microparticle from the aqueous dispersion of the colored resin particle containing released by-product microparticle obtained by the (3-1) pH adjustment process of redispersion of a colored resin particle.

A method of removing the by-product microparticle from the aqueous dispersion of the colored resin particle containing released by-product microparticle may not be limited if the by-product microparticle can be desirably removed without having an adverse affect on the colored resin particle. A wet classification device which classifies by centrifugal force is preferably used from the viewpoint that minute by-product microparticle having a particle diameter with less than 0.6 μm that is submicron order is efficiently removed.

As the wet classification device which classifies by centrifugal force, decanter centrifuge or wet cyclone is preferably used, and decanter centrifuge is particularly preferably used since the removing efficiency of the by-product microparticle is excellent.

An example of a method of removing the by-product microparticle from the aqueous dispersion of the colored resin particle containing released by-product microparticle by means of the decanter centrifuge will be hereinafter described.

The decanter centrifuge has a structure having outside rotating cylinder and screw conveyor relatively and rotatably provided within the outside rotating cylinder. The centrifugal force is generated by high-speed rotation of the outside rotating cylinder, thus solid content (wet colored resin particle) and liquid (aqueous dispersion containing by-product microparticle) can be separated and a wet colored resin particle from which the by-product microparticle is desirably removed can be obtained.

The centrifugal force generated by high-speed rotation of the outside rotating cylinder is preferably from 1,000 to 4,000 G, more preferably from 1,500 to 3,100 G.

If the above-mentioned centrifugal force is less than the above range, a separation ability of the solid content (wet colored resin particle) and the liquid (aqueous dispersion containing by-product microparticle) becomes low and removal of the by-product microparticle may be insufficient. On the other hand, if the above-mentioned centrifugal force exceeds the above range, the colored resin particle have an adverse affect such as crack or pulverization since a mechanical impact to the colored resin particle is too strong, therefore desired colored resin particle may not be obtained.

In addition, a difference of rotating speed between the outside rotating cylinder and the screw conveyor may be appropriately set, preferably from 1 to 30 revolutions per minute (rpm), more preferably from 5 to 20 revolutions per minute (rpm).

After removing the by-product microparticle from the aqueous dispersion of the colored resin particle containing released by-product microparticle, an average number of the by-product microparticle per the colored resin particle is preferably 40 or less, more preferably 30 or less and further more preferably 20 or less.

If the average number of the by-product microparticle per the colored resin particle exceeds the above range, it causes a clog on a filter element, may decrease a dewatering efficiency in the dewatering process and may have an adverse affect on a printing ability since the by-product microparticle which adheres to the surface of the colored resin particle can not be sufficiently released from the colored resin particle.

(3-3) Process of Obtaining a Redispersion of a Colored Resin Particle

The wet colored resin particle (wet cake) which is desirably carried out the removal of the by-product microparticle obtained by the (3-2) Removing process of a by-product microparticle is redispersed to appropriate solid content concentration by the use of the ion-exchange water.

In addition, the appropriate solid content concentration is generally 15 to 35% by weight, preferably 20 to 25% by weight, which can be used in the following dewatering process (4).

(4) Dewatering Process

The present process comprises (4-1) Aggregation formation process of a colored resin particle and (4-2) Dewatering process by means of a dewatering device. Clogs which may generate on the filter element are decreased by carrying out those processes, and thus desired dewatering can be achieved.

(4-1) Aggregation Formation Process of a Colored Resin Particle

An aggregate (floc) of the colored resin particle is formed by adding an acid and/or a cationic polymer flocculant as the flocculant into the redispersion of the colored resin particle with predetermined solid content concentration which is desirably removed the by-product microparticle obtained by the (3) Process of removing a by-product microparticle.

In addition, as the flocculant used in the present invention, the acid only is preferable if it is used by alone.

By adding the flocculant specified in the present invention into the redispersion of the colored resin particle with predetermined solid content concentration which is preferably removed the by-product microparticle obtained by the (3) Process of removing a by-product microparticle, the colored resin particle in a dispersion state so far is aggregated each other, therefore a big floc (aggregate of the colored resin particle) is formed. An aggregational state of the aggregate of the colored resin particle is not a rigid aggregational state so that if the aggregate of the colored resin particle is redispersed in the aqueous medium, an aggregational state is loose enough to easily loosen the aggregational state (loose flocculation state).

The aggregate of the colored resin particle formed in the present process is in such the loose flocculation state, so that a lot of paths (spacing) which are capable of passing water are secured in the wet cake when carried out the dewatering in the following (4-2) Dewatering process by means of a dewatering device. Therefore, the dewatering is easily carried out, the dewatering efficiency can be enhanced and a wet colored resin particle having low moisture content can be efficiently obtained.

pH of the redispersion of the colored resin particle when the acid is added as the flocculant is preferably 2 to 6, more preferably 4 to 6.

If pH of the redispersion of the colored resin particle when the acid is added as the flocculent is less than the above range, a corrosion of equipment may be easily occurred because of increase in a degree of acid of the aqueous dispersion of the colored resin particle. On the other hand, if pH of the redispersion of the colored resin particle adding the acid as the flocculant exceeds the above range, the aggregate of the colored resin particle is hardly formed and the wet colored resin particle (wet cake) having low moisture content may be difficult to be obtained.

As the acid used as the flocculant in the present invention, it may not be particularly limited. For example, there may be inorganic acid such as sulfuric acid, hydrochloric acid, nitric acid or the like, and organic acid such as formic acid, acetic acid or the like. Among them, sulfuric acid is particularly preferably used as having high effect as the flocculent.

In addition, the acid used as the flocculent in the present invention may be used alone or in combination of two or more kinds.

The acid used as the flocculant in the present invention is preferably used after controlling a concentration to low concentration. It is preferable to use acid aqueous solution as the flocculant whose acid concentration is controlled to preferably 0.05 to 1% by weight, more preferably 0.1 to 0.5% by weight, further more preferably 0.1 to 0.2% by weight.

In addition, the added amount of the acid depends on the acid concentration, however, if pH of the redispersion of the colored resin particle after adding the acid is to be 2 to 6, the added amount of the acid is not particularly limited.

If the concentration of the acid used as the flocculent is less than the above range, large amount of flocculants (acid) are required to aggregate the colored resin particle in the present process, and the dewatering efficiency may deteriorate as requiring much time to dewatering in the present process by decreasing the solid content concentration of the redispersion of the colored resin particle and increasing an amount of the liquid. On the other hand, if the acid concentration used as the flocculant exceeds the above range, pH of the redispersion of the colored resin particle is hardly adjusted to desired pH and may be difficult to form the aggregate of the colored resin particle.

As a cationic polymer flocculent used as the flocculent in the present invention, there may not be particular limited if the cationic polymer flocculant has cationic part. For example, there may be dimethylaminoethyl acrylate based polymer flocculent (following Formula 1) (it may be referred as "DAA series"), dimethylaminoethyl methacrylate based polymer flocculant (following Formula 2) (it may be referred as "DAM series") and polyvinylamidine based polymer flocculant (following Formula 3) or the like. Among them, dimethylaminoethyl acrylate based polymer flocculent ("DAA series") is preferably used as having high performance as the flocculant.

In addition, the cationic polymer flocculant used as the flocculant in the present invention may be used alone or in combination of two or more kinds.

Formula 1

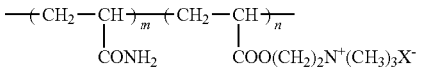

Formula 2

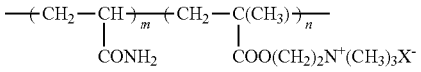

Formula 3

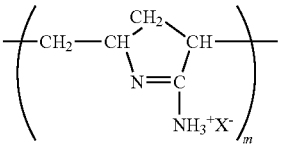

In the above Formula 1 to 3, "$X^{31}$" is a monovalent counter anion, there may be halogen ion such as fluorine ion, chlorine ion, bromine ion, and iodine ion; nitrate ion; bicarbonate ion; hydrogensulfate ion; and perchlorate ion or the like. Among them, halogen ion is preferable.

In addition, in the above Formula 1 to 3, "m", "n" is number of repeating units in the copolymer.

An added amount of the cationic polymer flocculant used as the flocculent in the present invention is preferably from 0.001 to 1 parts by weight, more preferably 0.002 to 0.5 parts by weight, further more preferably 0.002 to 0.1 parts by weight, with respect to the colored resin particle of 100 parts by weight.

If the added amount of the cationic polymer flocculant used as the flocculant in the present invention is out of the above range, the aggregate of the colored resin particle is hardly formed and may be difficult to obtain the wet colored resin particle (wet cake) having low moisture content.

A ratio ($Dv_2/Dv_1$) of a volume average particle diameter ($Dv_2$) of the colored resin particle after aggregation and a volume average particle diameter ($Dv_1$) of the colored resin particle obtained by the (1) Process of obtaining an aqueous dispersion of a colored resin particle may be preferably $1.05<(Dv_2/Dv_1)<2.0$, more preferably $1.2<(Dv_2/Dv_1)<1.5$.

If the ratio of the volume average particle diameter ($Dv_2/Dv_1$) of the colored resin particle before and after forming the aggregate is less than the above range, the aggregate of the colored resin particle cannot be sufficiently formed and the wet colored resin particle (wet cake) having low moisture content may be hardly obtained. On the other hand, if the ratio of the volume average particle diameter ($Dv_2/Dv_1$) of the colored resin particle before and after forming the aggregate exceeds above range, excessive aggregate is formed and clogs on a pump for fluid channeling or the like may be caused.

(4-2) Dewatering Process by Means of a Dewatering Device

A aqueous dispersion containing an aggregated colored resin particle obtained by the (4-1) Aggregation formation process of a colored resin particle is dewatered by means of the dewatering device and then the wet colored resin particle (wet cake) having low moisture content is formed.

As a method of dewatering the aqueous dispersion containing the aggregated colored resin particle obtained by the (4-1) Aggregation formation process of a colored resin particle, it may not be particularly limited and various known methods can be used. For example, there may be the dewatering method applying a centrifugal filtration, a vacuum filtration and a pressure filtration or the like.

As the dewatering device used in the present process, there may not be particular limited if the device can obtain the wet colored resin particle (wet cake) having desirable low moisture content. For example, there may be a dewatering device using the centrifugal filtration such as a siphon peeler centrifuge, a decanter centrifuge; a dewatering device using the vacuum filtration such as a belt filter; a dewatering device using the pressure filtration such as a filter press, belt press, rotary filter. Among them, the siphon peeler centrifuge is preferably used as having high dewatering efficiency. As a commercial product, there may be a siphon peeler centrifuge (product name: Type Hz-40Si) manufactured by Mitsubishi Kakoki Kaisha, Ltd. or the like.

A moisture content of the wet colored resin particle (wet cake) obtained by the dewatering is preferably 5 to 15% by weight, more preferably 7 to 13% by weight.

If the moisture content of the wet colored resin particle (wet cake) exceeds the above range, much drying time is required until the colored resin particle becomes desired drying state in the following (5) Drying process and a drying efficiency decreases and a productivity of a toner may decrease.

The electric conductivity of filtrate which is discharged by dewatering is preferably 100 μS/cm or less, more preferably 50 μS/cm or less.

If the electric conductivity of the filtrate which is discharged by the dewatering exceeds the above range, deterioration of an image quality by fog or the like is likely to occur and printing ability may have an adverse affect in an environment of high temperature and high humidity.

(5) Drying Process

Desired colored resin particle can be obtained by collecting the wet colored resin particle (wet cake) having low moisture content obtained through the (4) Dewatering process and drying the colored resin particle.

As a method of drying the wet colored resin particle (wet cake) having low moisture content obtained through the (4) Dewatering process, there may not be particular limited and various known methods can be used. For example, there may be a vacuum drying method, a flush drying method, a spray drying method and a fluid-bed drying method or the like.

As a dryer used in the present process, there may not be particular limited if it is a dryer which can obtain desired colored resin particle and various commercial dryers can be used. For example, a dryer using a vacuum drying method such as a vacuum dryer (product name: Nauta Mixer NXV-1) manufactured by HOSOKAWAMICRON CORPORATION, a vacuum dryer (product name: RIBOCONE) manufactured by OKAWARA MFG. CO., LTD., a vacuum dryer (product name: SV mixer) manufactured by Kobelco Eco-Solutions Co, LTD.; a dryer using a flush drying method such as a flush dryer (product name: Dry Master DMR) manufactured by HOSOKAWAMICRON CORPORATION, a flush dryer (product name: Flash Jet Dryer) manufactured by Seishin Enterprise Co., Ltd.; a dryer using a fluid-bed drying method such as a fluid-bed dryer (product name: SLIT FLOW) manufactured by OKAWARA MFG. CO., LTD. are typically exemplified.

If the wet colored resin particle (wet cake) having low moisture content obtained through the (4) dewatering process is dried in accordance with the above mentioned known drying method, the colored resin particle which has been in an aggregating state is broken down until it goes independent particles respectively. A volume average particle diameter (Dv) of the colored resin particle whereby has nearly the same diameter range as the volume average particle diameter ($Dv_1$) of the colored resin particle obtained through the (1) Process of obtaining an aqueous dispersion of a colored resin particle.

A moisture content of the colored resin particle obtained by drying is preferably 0.4% by weight or less, more preferably 0.3% by weight or less, further more preferably 0.2% by weight or less.

If the moisture content of the dried colored resin particle exceeds the above range, a deterioration of an image quality by fog or the like is likely to occur and printing ability such as printing durability or the like may have an adverse affect.

When the colored resin particle obtained by drying is redispersed in the ion-exchange water and a redispersion of the colored resin particle with 20% by weight of solid content concentration is adjusted, the electric conductivity of the filtrate obtained by filtration of the redispersion is preferably 20 μS/cm or less, more preferably 15 μS/cm or less, further more preferably 10 μS/cm or less.

If the electric conductivity of the filtrate exceeds the above range, a deterioration of an image quality by fog or the like is likely to occur and printing ability such as printing durability or the like may have an adverse affect in an environment of high temperature and high humidity.

(6) Colored Resin Particle

A colored resin particle obtained through the (5) Drying process will be hereinafter described.

The colored resin particle which will be hereinafter described includes both core-shell type and non core-shell type.

A volume average particle diameter (Dv) of the colored resin particle which composes the polymerized toner is preferably 4 to 10 μm, more preferably 5 to 9 μm from the viewpoint of image reproducibility.

If the volume average particle diameter Dv of the colored resin particle is less than the above range, a flowability of a toner lowers, deterioration of an image quality by fog or the like may be likely to occur and printing ability may have an adverse affect. On the other hand, if the volume average particle diameter Dv of the colored resin particle exceeds the above range, resolution of an image to be obtained is likely to decline and may have the adverse affect on the printing ability.

Also, a particle size distribution (Dv/Dn) which is a ratio of the volume average particle diameter (Dv) and number average particle diameter (Dn) of the colored resin particle is preferably 1 to 1.25, more preferably 1 to 1.2 from the viewpoint of image reproducibility.

If the particle size distribution (Dv/Dn) of the colored resin particle exceeds the above range, a flowability of a toner lowers, deterioration of an image quality by fog or the like may be likely to occur and printing ability may have an adverse affect.

In addition, the volume average particle diameter (Dv) and number average particle diameter (Dn) of the colored resin particle are value measured with the use of particle size analyzer.

An average degree of circularity of the colored resin particle is preferably 0.95 to 0.995, more preferably 0.97 to 0.985 from the viewpoint of image reproducibility.

If the average degree of circularity of the colored resin particle is less than above range, thin line reproducibility of a toner printing is likely to lower and the printing ability may have an adverse affect.

(7) Toner

The colored resin particle obtained from the present invention may be used as it is for the toner. Also, the colored resin particle and a carrier particle (ferrite, iron powder or the like) may be mixed to make the toner. The colored resin particle and an external additive may be mixed by means of a high speed agitator (for example, product name: FM mixer (manufactured by MITSUI MINING COMPANY, LIMITED) or the like) to form a one-component toner from the viewpoint of controlling charge property of a toner, flowability and shelf stability or the like. After mixing the colored resin particle and the external additive, the carrier particle is further mixed and may be formed a two-component developer.

As the external additives, there may be an inorganic microparticle such as silica, titanium oxide, aluminum oxide, zinc oxide, tin oxide, calcium carbonate, calcium phosphate, cerium oxide or the like; an organic microparticle such as polymethymethacrylate resin, silicone resin and melamine resin or the like. Among them, the inorganic microparticle is preferable. Among the inorganic microparticle, silica and titanium oxide are preferable. Particularly, silica is suitable. The external additives may be used alone or it may be preferable to use two or more kinds of the external additives together.

In the present invention, it is preferable that the ratio of the external additives is generally from 0.1 to 6 parts by weight, preferably from 0.2 to 5 parts by weight, with respect to the colored resin particle of 100 parts by weight.

The toner is produced by the above processes (1) to (7), the processes including:

the separation and washing process wherein washing is carried out to enhance the washing level of the colored resin particle to the extent that the electric conductivity of the filtrate obtained by filtrating the redispersion of the colored resin particle is a predetermined value or less;

the by-product microparticle removing process wherein, after washing, pH of the redispersion of the colored resin particle having high washing level is pH adjusted to a predetermined alkalinity and a by-product microparticle is removed from the pH adjusted redispersion of the colored resin particle; and the dewatering process wherein, after removing the by-product microparticle, a specific flocculent is added into the redispersion of the colored resin particle from which the by-product microparticle is removed to aggregate the colored resin particle and then dewatering is carried out, whereby the wet colored resin particle (wet cake) having low moisture content can be efficiently obtained with prevention of clogs on the filter element in the dewatering process, and the drying efficiency also becomes high (shorten the drying time) in the drying process, thus the toner having an excellent productivity and printing ability is obtained.

EXAMPLES

The present invention will be hereinafter explained further in detail with reference to Examples and Comparative examples. However, the scope of the present invention may not be limited to the following examples. Herein, "part(s)" and "%" are based on weight if not particularly mentioned.

In the Examples and the Comparative examples, the testing methods performed are as follows.

(Testing Methods)

(1) Measurement of Particle Diameter (1-1) Volume Average Particle Diameter ($Dv_1$) of a Colored Resin Particle Before Aggregation and Volume Average Particle Diameter ($Dv_2$) of Aggregated Colored Resin Particle About 0.1 g of a testing sample (colored resin particle) was weighted in a beaker, and 10 to 30 ml of ISOTON® II was further added in the beaker followed by agitating by means of spatula. Then, the volume average particle diameter ($Dv_1$) of the colored resin particle after polymerization and the volume average particle diameter ($Dv_2$) of the aggregated colored resin particle were respectively measured by means of a particle size analyzer (product name: Multisizer; manufactured by Beckman Coulter, Inc.) under the condition of aperture diameter; 100 μm, medium; ISOTON® II, number of measured particles; 100,000 particles.

(1-2) Volume Average Particle Diameter (Dv) of Dried Colored Resin Particle and Particle Size Distribution (Dv/Dn)

About 0.1 g of a testing sample (colored resin particle) was weighted in a beaker, and 0.1 ml of aqueous solution of alkylbenzenesulfonates (product name: DRIWEL; manufactured by FUJIFILM Corporation) was added as a dispersant. 10 to 30 ml of ISOTON® II was further added in the beaker followed by dispersing for 3 minutes by means of an ultrasonic disperser with 20 W. Then, the volume average particle diameter (Dv) and number average particle diameter (Dn) of dried colored resin particle were measured by means of a particle size analyzer (product name: Multisizer; manufactured by Beckman Coulter, Inc.) under the condition of aperture diameter; 100 μm, medium; ISOTON® II, number of measured particles; 100,000 particles, thereby the particle size distribution (Dv/Dn) was calculated.

(1-3) Average Degree of Circularity of Dried Colored Resin Particle 10 ml of ion-exchange water was put in a container in advance. 0.02 g of surface active agent (alkylbenzenesulfonates) as the dispersant was added, and 0.02 g of the testing sample (colored resin particle) was further added in the container, then it was dispersed 3 minutes by means of an ultrasonic disperser with 60 W. The concentration of the colored resin particle at measurement was adjusted to be 3,000 to 10,000 particle/μl, 1,000 to 10,000 of the colored resin particle having a diameter equivalent to a circle having a diameter of 0.4 μm or more was measured by means of a flow particle image analyzer (product name: FPIA-2100; manufactured by SYSMEX CORPORATION). Thereby, an average degree of circularity was calculated from a measurement value.

The degree of circularity is shown in the following Calculating formula 1. The average degree of circularity is a value which takes the average thereof.

(Degree of circularity)=(Boundary length of a circle which is equivalent to projected area of a particle)/(Boundary length of particle projected image) Calculating formula 1

(2) Measurement of an Electric Conductivity

The electric conductivity of the filtrate was measured by means of conductance meter (product name: ES-12; manufactured by HORIBA) for the filtrate obtained by each process of the separation and washing process and the drying process. The electric conductivity of the substantial filtrate was obtained by the following Calculating formula 3.

An electric conductivity of filtrate (μS/cm)=$A-B$ Calculating formula 3

A: electric conductivity of measured filtrate (μS/cm)

B: electric conductivity of ion-exchange water (μS/cm)

(3) Average Number of a By-Product Microparticle 1 ml of 10% $H_2SO_4$ was added to 3 ml of the redispersion of the colored resin particle after the separation and washing process, and the dispersion stabilizer was completely dissolved. 2 ml of the solution was dropped on the filter paper (product name: No. 2; manufactured by ADVANTEC MFS, INC.) and filtrated it, then a sample for scanning electron microscope (SEM) was prepared by air drying.

Platinum deposition was carried out on the air dried colored resin particle and observed by scanning electron microscope (SEM) with 5,000 times in magnification with the use of a field emission scanning electron microscope (product name: S-4700; manufactured by Hitachi, Ltd.) with an accelerating voltage of 5 kV.

Five fields of view were randomly photographed for each sample. Five colored resin particle were randomly selected for each field of view and number of by-product microparticle which can be observed on the surface of 25 colored resin particles was calculated. Accordingly, an average number of a by-product microparticle per a colored resin particle was calculated.

In addition, an average number of a by-product microparticle per a colored resin particle was calculated similarly for the redispersion of the colored resin particle after by-product microparticle removing process.

(4) Evaluation of Clogs Caused at Filter Element

The clogs caused on a surface of the filter element after the dewatering process was visually observed. Further, in the case of generating clogs at the filter element, a part of clogged colored resin particle was scraped out, which was observed by scanning electron microscope (SEM), then evaluated as follows.

○: clogs were not observed.

Δ: clogs were observed and a small amount of by-product microparticle were observed.

X: clogs were observed and a large amount of by-product microparticle were observed.

(5) Measurement of Moisture Content

About 5 g of the wet colored resin particle (wet cake) obtained by dewatering process was weighted, and taken on an aluminum plate and precisely weighted ($W_1$(g)). Next, it was left for 2 hours in a dryer which was set at 105° C. and precisely weighted ($W_2$(g)) after cooling, thereby the moisture content was calculated by the following Calculating formula 4.

In addition, the moisture content (%) was calculated similarly for dried colored resin particle obtained by the drying process.

$$\text{Moisture content (\%)} = \frac{W_1 - W_2}{W_1} \times 100 \qquad \text{Calculating formula 4}$$

(6) Printing Test (6-1) Printing Durability (Under Environment N/N, Under Environment H/H)

A commercially available printer (printing speed: 26 prints by A4 size per minute) of a non-magnetic one-component developing method was used. A toner was filled in a toner cartridge of a development apparatus, and thereafter printing papers were set.

After leaving the printer in an atmosphere of ordinary temperature and ordinary humidity (N/N) (temperature: 23° C., humidity: 50%) for 24 hours, 10,000 prints were continuously printed with 5% image density in the same environment.

A black solid patterned print (100% image density) was printed every 500 prints and image density of a black solid patterned image was measured by means of a reflective image densitometer (product name: RD914; manufactured by Macbeth Process Measurements Co.). After that, a white solid patterned print (0% image density) was printed and the printer was halted while printing the white solid patterned printing. Then, a toner at non-image area on a photosensitive member after development was adhered to an adhesive tape (product name: Scotch Mending Tape 810-3-18; manufactured by Sumitomo 3M Limited) followed by tearing it off, and then it was attached to the printing paper. Next, a degree of whiteness (B) of a printing paper to which the adhesive tape was attached was measured by means of whiteness colorimeter (product name: ND-1; manufactured by NIPPON DENSHOKU INDUSTRIES CO., LTD.). Similarly, only unused adhesive tape was attached to the printing paper, then the degree of whiteness (A) was measured, as a result, the difference of the degree of whiteness (B-A) was evaluated as a fog value (%). The smaller the value was, the better condition with a small amount of fogs was shown.

Number of continuous printing sheets having 1.3 or more image density and which can keep an image quality with fog value with 5% or less was determined.

In addition, similar printing durability test was performed in an atmosphere of high temperature and high humidity (H/H) (temperature: 35° C., humidity: 80%).

In Table 1, results of printing test which is described as "10,000<" means that the image quality is kept to the extent that the image density was 1.3 or more and the fog value was 5% or less at printing 10,000 sheets.

The test in an atmosphere of ordinary temperature and ordinary humidity (N/N) was performed at the same time of performing the following test of (6-2) Generating white stripe. After the white stripe was generated, printing durability was not evaluated.

(6-2) Generating White Stripe

A commercially available printer (printing speed: 26 prints by A4 size per minute) of a non-magnetic one-component developing method was used. A toner was filled in a toner cartridge of a development apparatus, and thereafter printing papers were set.

After leaving the printer in an atmosphere of ordinary temperature and ordinary humidity (N/N) (temperature: 23° C., humidity: 50%) for 24 hours, the printing test was carried out with 5% image density in the same environment and a black solid patterned printing (100% image density) was printed every 500 prints, then generation of white vertical stripes (white stripe) was observed. Number of printed sheets (number of printed sheets of generating white stripe) when a white stripe on the black solid patterned printing was observed for the first time was counted, and the printing test was carried out up to 10,000 printing.

In addition, in Table 1, results of printing test which is described as "10,000<" means that white vertical stripe (white stripe) did not generate at printing 10,000 sheets.

Example 1

Process of Obtaining an Aqueous Dispersion of a Colored Resin Particle 81 parts of styrene and 19 parts of n-butyl acrylate (Tg of copolymer to be obtained=55° C.) as a monovinyl monomer, 0.3 parts of polymethacrylic acid ester macromonomer (product name: AA6; manufactured by Toagosei Co., Ltd., Tg of polymer to be obtained=94° C.) as macromonomer, 0.5 parts of divinylbenzene as crosslinkable polymerizable monomer, 1.2 parts of t-dodecyl mercaptan as molecular weight modifier and 7 parts of carbon black (product name: #25B; manufactured by Mitsubishi Chemical Corporation) as a black colorant were subjected to wet crushing by means of a media type dispersing machine.

1 part of charge control resin (product name: Acrybase FCA-207P; manufactured by Fujikura Kasei Co., Ltd., styrene/acrylate resin) as a charge control agent and 7 parts of dipentaerythritol hexamyristate (product name: W-663; manufactured by NOF Corporation) as a parting agent were added into a mixture obtained by the wet crushing, and mixed and dissolved. Then polymerizable monomer composition was obtained.

An aqueous solution of 8.9 parts sodium hydroxide dissolved in 50 parts of ion-exchanged water was gradually added into an aqueous solution of 15.9 parts magnesium chloride dissolved in 170 parts of ion-exchanged water while agitating at room temperature. Thereby, a magnesium hydroxide colloid (hardly water-soluble metal hydroxide colloid) dispersion liquid was prepared.

On the other hand, 1 part of methyl methacrylate (Tg of polymer to be obtained=105° C.) and 65 parts water were subjected to finely-dispersing treatment by means of an ultrasonic emulsifying machine, then an aqueous dispersion of polymerizable monomer for shell was obtained.

The polymerizable monomer composition was charged into the magnesium hydroxide colloid dispersion liquid (6.5 parts of magnesium hydroxide colloid) and agitated at room temperature. Thereto, as a polymerization initiator, 5 parts of t-butylperoxy-2-ethylhexanoate (product name: PERBUTYL O; manufactured by Nihon Yushi Co., Ltd.) was added. Thereafter, a high shear stirring was performed at 15,000 rpm by means of an in-line type emulsifying and dispersing machine (product name: MILDER; manufactured by Pacific Machinery & Engineering Co., Ltd.) until suspending solution (dispersion of polymerizable monomer composition) was circulated for 10 cycles to form droplets of the polymerizable monomer composition, thus obtained an aqueous dispersion of the polymerizable monomer composition.

A suspending solution (dispersion of polymerizable monomer composition) in which the droplets of the polymerizable monomer composition was dispersed was charged into a reactor equipped with a stirring vane, was raised to 90° C., and then polymerization reaction was started. When a polymerization conversion rate reached nearly 100%, 0.1 parts of 2,2'-azobis(2-methyl-N-(2-hydroxyethyl)propionamide) (product name: VA-086; manufactured by Wako Pure Chemical Industries, Ltd., water soluble) as a polymerization initiator for shell was dissolved in an aqueous dispersion of the polymerizable monomer for shell, and it was added into the reactor and kept reaction at 90° C. for 4 hours. Thereafter, the reaction was halted by cooling water, whereby obtained an aqueous dispersion of the colored resin particle (pH 9.3) having a core shell type structure.

A part of the obtained aqueous dispersion of the colored resin particle was taken. Then, the volume average particle diameter ($Dv_1$) of the colored resin particle was measured.

(Separation and Washing Process)

While the aqueous dispersion of the colored resin particle was agitated at room temperature, 10% of aqueous solution of dilute sulfuric acid (aqueous solution containing 10% by weight of sulfuric acid) was dropped and washed by acid, and then pH adjustment was performed until pH of the aqueous dispersion of the colored resin particle became 6.0.

The pH adjusted aqueous dispersion of the colored resin particle (pH 6.0) was supplied to continuous belt filter (product name: Eagle filter; manufactured by Sumitomo Heavy Industries, Ltd.) under the following condition, and subjected to solid-liquid separation to form the wet colored resin particle (wet cake). Thereafter, about 6 times the amount of ion-exchange water (electric conductivity: 5 μS/cm) was supplied, with respect to the solid content in the aqueous dispersion of the colored resin particle and washing was carried out. Accordingly, wet colored resin particle (wet cake) was obtained.

<Condition of Separation and Washing>

Supply amount of aqueous dispersion of a colored resin particle: 200 kg/hr

Filtration area: 1 $m^2$

Belt speed: 0.6 m/min

Degree of vacuum: 35.7 to 42.4 kPa

Filter element: plain-woven polypropylene (product name: PP312B; manufactured by Nakao Filter Media Corporation)

Permeability rate of filter element: 1.3 cc/sec/$cm^2$

Supply amount of ion-exchange water: 240 kg/hr

The wet colored resin particle (wet cake) obtained by the washing was redispersed in ion-exchange water (electric conductivity: 5 μS/cm) and the redispersion was prepared to be 20% by weight of solid content concentration, thereby the redispersion of the colored resin particle was obtained.

pH of the obtained redispersion of the colored resin particle was pH 8.0. Also, a part of the redispersion of the colored resin particle was taken and filtrated by filter paper (product name: No. 5C; manufactured by ADVANTEC MFS, INC.), and then the electric conductivity of the obtained filtrate was measured. As a result, the electric conductivity was 250 μS/cm.

Further, a part of redispersion of the colored resin particle was taken and number of by-product microparticle which can be observed on the surface of the colored resin particle was counted, then an average number of a by-product microparticle per a colored resin particle was calculated. As a result, the average number of by-product microparticle was 120.

(Process of Removing a by-product Microparticle)

While the redispersion of the colored resin particle (pH8.0) was agitated at room temperature, 0.1% of NaOH solution (aqueous solution containing 0.1% by weight of NaOH) was dropped until pH became 11.0 to adjust pH. The pH adjusted redispersion of colored resin particle (pH 11.0) was dispersed, and thus a by-product microparticle adhering to the surface of the colored resin particle was released from the colored resin particle.

The aqueous dispersion of the colored resin particle (pH 11.0) containing the released by-product microparticle was supplied to Decanter Centrifuge (product name: PTM-006; manufactured by Tomoe Engineering Co., Ltd.) under the following condition and subjected to centrifugal separation to remove the by-product microparticle, then the wet colored resin particle (wet cake) was obtained.

<Condition of Centrifugal Separation>

Supply amount of aqueous dispersion of a colored resin particle containing released by-product microparticle: 150 kg/hr Centrifugal force: 2,000 G Difference of rotating speed between an outside rotating cylinder and screw conveyor: 10 $min^{-1}$ The wet colored resin particle (wet cake) obtained by removing the by-product microparticle was redispersed in ion-exchange water (electric conductivity: 5 μS/cm) and the redispersion was prepared to be 20% by weight of solid content concentration, thereby the redispersion of the colored resin particle was obtained.

In addition, pH of the obtained redispersion of the colored resin particle was pH 9.5. Also, a part of redispersion of the colored resin particle was taken and number of by-product microparticle which can be observed on the surface of the colored resin particle was counted, then an average number of a by-product microparticle per a colored resin particle was calculated. As a result, the average number of by-product microparticle was 2.

(Dewatering Process)

0.1% of aqueous solution of dilute sulfuric acid (aqueous solution containing 0.1% by weight of sulfuric acid) as the flocculant was added into the redispersion of the colored resin particle (pH 9.5) and pH of the redispersion of the colored resin particle is adjusted to pH 4.2, thus the colored resin particle was aggregated.

In addition, a part of the colored resin particle after aggregation was taken and a volume average particle diameter ($Dv_2$) of the colored resin particle after aggregation was measured.

The aqueous dispersion (pH 4.2) containing the aggregated colored resin particle was supplied to Siphon peeler Centrifuge (product name: Type Hz-40Si; manufactured by Mitsubishi Kakoki Kaisha, Ltd.) under the following condition and subjected to centrifugal dewatering, thus the wet colored resin particle (wet cake) was obtained.

<Condition of Dewatering>

Supply amount of aqueous dispersion containing aggregated colored resin particle: 7 kg Filtration area: 0.25 $m^2$ Centrifugal force: 1,600 G Time of supply: 30 sec Time of dewatering: 180 sec Filter element: polyester filter cloth (product name: TR815C; manufactured by Nakao Filter Media Corporation)

Permeability rate of filter element: 0.8 cc/sec/$cm^2$

A part of wet cake obtained by dewatering was taken and a moisture content of the wet cake was measured. As a result, the percentage was 9.5%. Also, a part of filtrate which was discharged by dewatering was taken and an electric conductivity of the filtrate was measured. As a result, the electric conductivity was 40 μS/cm.

(Drying Process)

The wet colored resin particle (wet cake) obtained by the dewatering was collected and 30 kg thereof was weighted. Then it was charged into Vacuum dryer (product name: Nauta Mixer NXV-1; manufactured by Hosokawa Micron Corporation). Under the following condition, drying was carried out until the moisture content of the wet cake became 0.2% by weight, then the colored resin particle was obtained.

<Condition of Drying>

Degree of vacuum: 28 Torr (3.7 kPa)

Jacket temperature: 47° C.

A time required for drying the colored resin particle until the moisture content of the wet cake became 0.2% by weight was counted, and the time took 3.5 hr.

Also, a part of the colored resin particle obtained by the drying was taken and redispersed in the ion-exchange water (electric conductivity: 5 μS/cm) to prepare redispersion with 20% by weight of the solid content concentration. A part of the obtained redispersion of the colored resin particle was taken and filtrated by filter paper (product name: No. 5C; manufactured by ADVANTEC MFS, INC.). Then the electric conductivity of the obtained filtrate was measured, and determined as 6 μS/cm.

Furthermore, a part of the colored resin particle obtained by the drying was taken and a volume average particle diameter (Dv) of the dried colored resin particle, a particle size distribution (Dv/Dn) and an average degree of circularity were measured.

With respect to 100 parts of the colored resin particle obtained by the drying, 1 part of silica microparticle subjected to a hydrophobic treatment with cyclic silazane and having a number average primary particle diameter of 7 nm and 1 part of silica microparticle subjected to a hydrophobic treatment with amino modified silicone oil and having a number average primary particle diameter of 35 nm were added, and mixed and agitated to carry out an external additive treatment by means of the high speed agitator (product name: FM mixer; manufactured by MITSUI MINING COMPANY, LIMITED), whereby a positive charged toner in Example 1 was produced and which was used for the printing test.

Example 2

A positive charged toner of Example 2 was produced and subjected to the printing test in the same manner as Example 1 except that: pH of the aqueous dispersion of the colored resin particle before separation and washing was changed from 6.0 to 5.5 in the separation and washing process; pH of the pH adjusted redispersion of the colored resin particle was changed from 11.0 to 10.0 in the by-product microparticle removing process; further pH of the redispersion of the colored resin particle after adding the flocculant was changed from 4.2 to 6.0 in the dewatering process.

Comparative Example 1

A positive charged toner of Comparative Example 1 was produced and subjected to the printing test in the same manner as Example 1 except that: pH of the aqueous dispersion of the colored resin particle before separation and washing was changed from 6.0 to 5.8 in the by-product microparticle removing process; pH adjustment was not carried out to the predetermined alkalinity in the by-product microparticle removing process; further the flocculant was not added in the dewatering process.

Comparative Example 2

A positive charged toner of Comparative Example 2 was produced and subjected to the printing test in the same manner as Example 1 except that: the dispersion of magnesium hydroxide colloid is prepared by changing an adding amount of magnesium chloride and sodium hydroxide from 15.9 parts to 10.3 parts and from 8.9 parts to 5.8 parts respectively, and the obtained dispersion of magnesium hydroxide colloid (the amount of magnesium hydroxide colloid: 4.2 parts) was used to carry out a droplet formation of the polymerizable monomer composition in the process of obtaining the aqueous dispersion of a colored resin particle; and pH adjustment was not performed to the predetermined alkalinity in the by-product microparticle removing process; and the flocculant was not added in the dewatering process.

Comparative Example 3

A positive charged toner of Comparative Example 3 was produced and subjected to the printing test in the same manner as Example 1 except that: the by-product microparticle removing process was not provided; further pH of the redispersion of the colored resin particle after adding the flocculant was change from 4.2 to 3.5 in the dewatering process.

Comparative Example 4

A positive charged toner of Comparative Example 4 was produced and subjected to the printing test in the same manner as Example 1 except that: pH of the aqueous dispersion of the colored resin particle before separation and washing was changed from 6.0 to 6.5 in the separation and washing process; and the by-product microparticle removing process was not provided; further the flocculant was not added in the dewatering process.

(Results)

The test results of a toner produced by each Example and Comparative example are shown in Table 1.

TABLE 1

| | Example 1 | Example 2 | Comparative Example 1 | Comparative Example 2 | Comparative Example 3 | Comparative Example 4 |
|---|---|---|---|---|---|---|
| (Process of obtaining an aqueous dispersion of a colored resin particle) | | | | | | |
| A volume average particle diameter $Dv_1$ of a colored resin particle (μm) | 6.8 | 6.8 | 6.8 | 9.8 | 7.4 | 7.5 |
| (Separation and washing process) | | | | | | |
| pH of an aqueous dispersion of a colored resin particle before separation/washing | 6.0 | 5.5 | 5.8 | 6.0 | 6.0 | 6.5 |
| Electric conductivity of filtrate of a redispersion of a colored resin particle (μS/cm) | 250 | 300 | 250 | 280 | 350 | 400 |
| Average number of a by-product microparticle per a colored resin particle (particles) | 120 | 120 | 120 | 100 | 110 | 110 |
| (By-product microparticle removing process) | | | | | | |
| pH of a pH adjusted redispersion of colored resin particle | 11.0 | 10.0 | 8.2 (*1) | 7.8 (*1) | — | — |
| Sort of alkaline used for pH adjustment | NaOH | Same as on the left | — | — | — | — |
| Sort of devices used for removing a by-product microparticle | Decanter | Same as on the left | Same as on the left | Same as on the left | — | — |
| Average number of a by-product microparticle per a colored resin particle (particles) | 2 | 7 | 30 | 8 | — | — |
| (Dewatering process) | | | | | | |
| Sort of flocculants | Sulfuric acid | Same as on the left | — | — | Sulfuric acid | — |
| pH of a redispersion of a colored resin particle after adding flocculants | 4.2 | 6.0 | 8.5 (*2) | 8.0 (*2) | 3.5 | 8.2 (*1) |
| A volume average particle diameter $Dv_2$ of a colored resin particle after being aggregated (μm) | 9.0 | 7.7 | 6.9 | 10.0 | 10.0 | 7.7 |
| A ratio of a volume average particle diameter of a colored resin particle before and after forming aggregate ($Dv_2/Dv_1$) | 1.32 | 1.13 | 1.01 | 1.02 | 1.35 | 1.03 |
| Moisture content of wet cake obtained by dewatering (%) | 9.5 | 11 | 20 | 15 | 14 | 22 |
| Evaluation of clogs caused at filter element | ○ | ○ | Δ | Δ | ○ | x |
| (Drying process) | | | | | | |
| Drying time for obtaining a colored resin particle with 0.2% of moisture content (hr) | 3.5 | 3.8 | 5.4 | 4.3 | 4.3 | 5.6 |
| Electric conductivity of filtrate of a redispersion of a colored resin particle (μS/cm) | 6 | 8 | 9 | 10 | 15 | 11 |
| (Colored resin particle) | | | | | | |
| A volume average particle diameter Dv of a colored resin particle (μm) | 6.8 | 6.8 | 6.8 | 9.8 | 7.4 | 7.5 |
| Particle size distribution Dv/Dn of a colored resin particle | 1.12 | 1.13 | 1.14 | 1.10 | 1.13 | 1.12 |
| Average degree of circularity of a colored resin particle | 0.978 | 0.980 | 0.976 | 0.975 | 0.982 | 0.973 |
| (Printing test) | | | | | | |
| Printing durability under N/N environment (sheets) | 10,000< | 10,000< | 7,000 | 8,000 | — | — |
| Printing durability under H/H environment(sheets) | 9,500 | 9,000 | 5,000 | 6,500 | 4,000 | 3,000 |
| Number of printed sheets of generating white stripe (sheets) | 10,000< | 10,000< | 10,000< | 10,000< | 500 | 500 |

(Summary of the Results)

Test results shown in Table 1 shows as follows.

A toner in Comparative examples 1 and 2 caused clogs at the filter element, required much time to obtain the wet cake having a low moisture content and had an low productivity and a poor printing ability since pH adjustment to the predetermined alkalinity was not performed in the by-product microparticle removing process and the flocculant was not used in the dewatering process so that a removal of by-product microparticle was insufficient.

A difference between an average number of a by-product microparticle per a colored resin particle in Comparative examples 1 and 2 concerned that particle diameter of the colored resin particle in Comparative example 2 was relatively big compared to the colored resin particle in Comparative example 1 as formed by the use of the dispersion containing a relatively small amount of magnesium hydroxide colloid, and it was presumed that a removal of a by-product microparticle became difficult if the colored resin particle has small particle diameter.

A toner in Comparative example 3 was produced by including the dewatering process specified in the present invention but not including the by-product microparticle removing process. Thus clogs at the filter element were prevented since the aggregate of the colored resin particle was formed, but the by-product microparticle was not sufficiently removed from the colored resin particle. Accordingly, much time was required to obtain the wet cake having low moisture content, and the productivity of a toner and the printing ability was low.

A toner in Comparative example 4 was produced by not including the by-product microparticle removing process, and by not using the flocculant in the dewatering process. Thus a lot of clogs at the filter element were caused. Accordingly, much time was required to obtain the wet cake having low moisture content, and the productivity of a toner and the printing ability were low.

In contrast, a toner in Examples 1 and 2 was produced by including the separation and washing process, the by-product microparticle removing process, and the dewatering process specified respectively in the present invention. Thus a removal of by-product microparticle was properly carried out in the by-product microparticle removing process, and clogs at the filter element were prevented in the dewatering process. Accordingly, the wet cake having low moisture content could be obtained in a short time, and the productivity of a toner and the printing ability were excellent.

What is claimed is:

1. A method of producing a polymerized toner comprising:

a step obtaining an aqueous dispersion of a colored resin particle by forming the colored resin particle by polymerization method;

a separation and washing step obtaining a redispersion of the colored resin particle by separation and washing of the colored resin particle in the aqueous dispersion of the colored resin particle, followed by redispersing the colored resin particle into an ion-exchange water;

a by-product microparticle removing step removing a by-product microparticle from the redispersion of the colored resin particle;

a dewatering step obtaining a wet colored resin particle by dewatering the redispersion of the colored resin particle; and a drying step drying the wet colored resin particle, wherein, in the above-mentioned separation and washing step, a belt filter is used as a device conducting separation and washing, and the separation and washing is carried out to enhance a degree of washing of the colored resin particle until an electric conductivity of filtrate becomes 500 μS/cm or less provided that the electric conductivity is determined with respect to the filtrate obtained by such manner that the colored resin particle obtained by separation and washing with the use of the belt filter is redispersed into the ion-exchange water to prepare the redispersion of the colored resin particle with 20 weight % of solid content concentration and filtrate it, and then the colored resin particle is redispersed again into the ion-exchange water to obtain the redispersion of the colored resin particle with the predetermined solid content concentration;

wherein, in the by-product microparticle removing step, pH of the redispersion of the colored resin particle with the predetermined solid content concentration is adjusted to 9-12, the by-product microparticle is removed from the redispersion of the pH adjusted colored resin particle, followed by redispersing the colored resin particle into the ion-exchange water to obtain the redispersion of the colored resin particle with the predetermined solid content concentration;

wherein, in the dewatering step, an acid and/or a cationic polymer flocculant as a flocculant is added into the redispersion of the colored resin particle with the predetermined solid content concentration to aggregate the colored resin particle, followed by dewatering to obtain the wet colored resin particle.

2. The method of producing the polymerized toner according to claim 1, wherein, in the separation and washing step, pH of the aqueous dispersion of the colored resin particle before separation and washing by means of the belt filter is 5 to 7.

3. The method of producing the polymerized toner according to claim 1, wherein, in the by-product microparticle removing step, alkali used in pH adjustment is an aqueous solution of alkali metal hydroxide.

4. The method of producing the polymerized toner according to claim 1, wherein, in the by-product microparticle removing step, a device using for removing a by-product microparticle from the pH adjusted redispersion of the colored resin particle is a decanter centrifuge or a wet cyclone.

5. The method of producing the polymerized toner according to claim 1, wherein, in the by-product microparticle removing step, an average number of by-product microparticle per the colored resin particle is 40 or less after removing the by-product microparticle from the pH adjusted redispersion of the colored resin particle.

6. The method of producing the polymerized toner according to claim 1, wherein, in the dewatering step, a flocculant to be added is acid, and the acid is sulfuric acid.

7. The method of producing the polymerized toner according to claim 1, wherein, in the dewatering step, pH of the redispersion of the colored resin particle is 2 to 6 when acid is added as the flocculant.

8. The method of producing the polymerized toner according to claim 1, wherein, in the dewatering step, a ratio $Dv_2/Dv_1$ of a volume average particle diameter of the colored resin particle ($Dv_2$) after being aggregated and a volume average particle diameter of the colored resin particle ($Dv_1$) obtained through a step obtaining the aqueous dispersion of the colored resin particle is $1.05<(Dv_2/Dv_1)<2.0$.

9. The method of producing the polymerized toner according to claim 1, wherein, in the dewatering step, a moisture content of the wet colored resin particle obtained by dewatering is 5 to 15 weight %.

10. The method of producing the polymerized toner according to claim 1, wherein, in the drying step, an electric conductivity of filtrate is 20 μS/cm or less provided that the electric conductivity is determined with respect to the filtrate obtained by such manner that the colored resin particle obtained by drying are redispersed in the ion-exchange water to prepare the redispersion of the colored resin particle with 20 weight % of solid content concentration and filtrate it.

11. The method of producing the polymerized toner according to claim 1, wherein, in the drying step, a volume average particle diameter of the colored resin particle (Dv) obtained by drying is 4 to 10 μm, an average degree of circularity is 0.95 to 0.995.

12. The method of producing the polymerized toner according to claim 1, wherein the polymerized toner is a positive charged toner.

* * * * *